US008105090B1

(12) United States Patent
Ding

(10) Patent No.: US 8,105,090 B1
(45) Date of Patent: Jan. 31, 2012

(54) ELECTRICAL CONNECTOR ASSEMBLY

(75) Inventor: You-Xiang Ding, Shenzhen (CN)

(73) Assignees: Fu Tai Hua Industry (Shenzhen) Co., Ltd., ShenZhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/912,776

(22) Filed: Oct. 27, 2010

(30) Foreign Application Priority Data

Sep. 28, 2010 (CN) ..... 2010 1 0294832

(51) Int. Cl.
*H01R 39/00* (2006.01)

(52) U.S. Cl. ..... 439/17

(58) Field of Classification Search ..... 439/17, 439/39, 348
See application file for complete search history.

(56) References Cited

U.S. PATENT DOCUMENTS 6,190,180 B1 * 2/2001 Purington et al. ..... 439/17
6,608,422 B2 * 8/2003 Bartman ..... 310/219

* cited by examiner

*Primary Examiner* — Phuong Dinh
(74) *Attorney, Agent, or Firm* — Altis Law Group, Inc.

(57) ABSTRACT

An electrical connector assembly includes a socket and a plug. The socket includes a first main body defining a first longitudinal receiving space. A sidewall of the first longitudinal receiving space defines a helical slot. The helical slot includes at least one entrance formed on an end of the first longitudinal receiving space. The plug includes a second main body and at least one fixing assembly mounted in a peripheral sidewall of the second main body. Each of the at least one fixing assembly includes a ball rotatably connected to and extends partially out of the peripheral sidewall of the second main body. The extending part of the at least one ball being is able to slide in the helical slot through the at least one entrance.

10 Claims, 6 Drawing Sheets

ELECTRICAL CONNECTOR ASSEMBLY

BACKGROUND

1. Technical Field

The present disclosure relates to connectors and, particularly, to an electrical connector assembly.

2. Description of Related Art

A socket of a power-supply electrical connector of a conventional notebook computer defines a cylindrical hole, and a plug of the power-supply electrical connector includes a cylindrical main body. The plug is secured to the socket by friction between the cylindrical main body and the cylindrical hole. Therefore, the plug may be easily pulled out of the socket, which may cause the notebook to be accidentally powered down.

BRIEF DESCRIPTION OF THE DRAWINGS

The components of the drawings are not necessarily drawn to scale, the emphasis instead being placed upon clearly illustrating the principles of an electrical connector assembly. Moreover, in the drawings, like reference numerals designate corresponding parts throughout several views.

DETAILED DESCRIPTION

Figure 1:
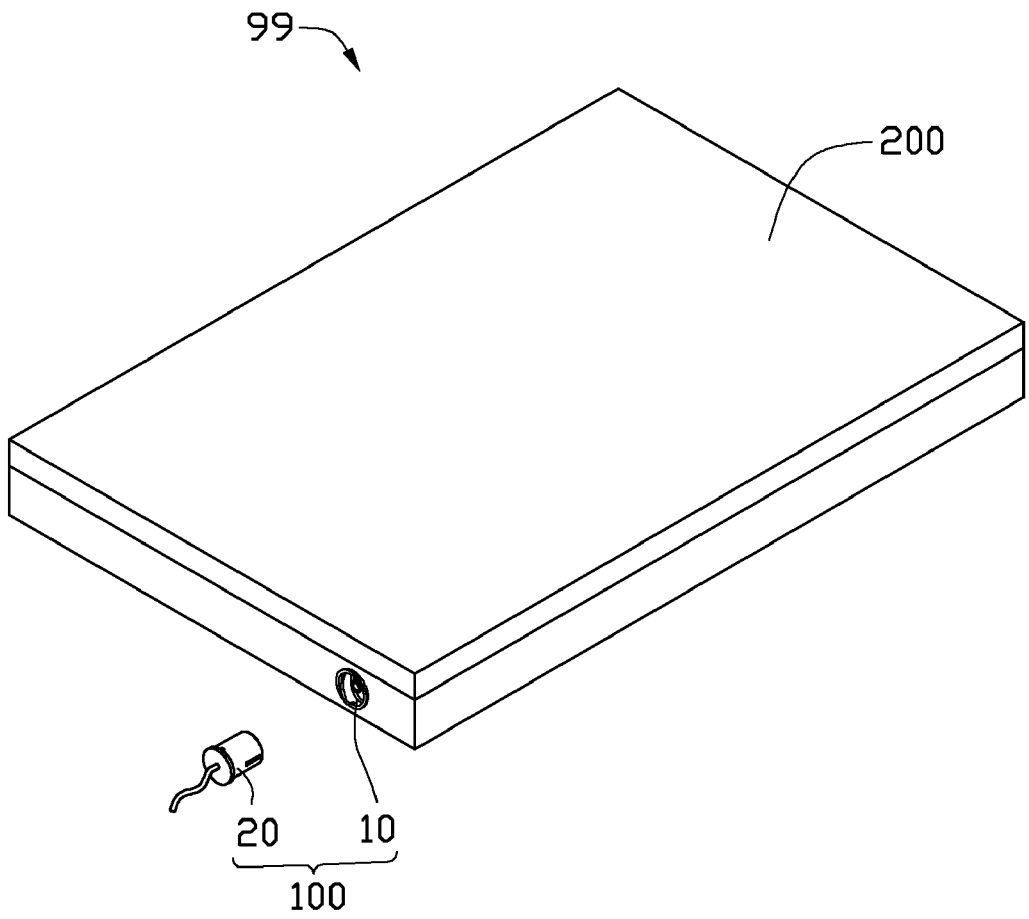
FIG. 1 is an isometric view of an electronic device in accordance with an exemplary embodiment, showing an electrical connector assembly.

Referring to FIG. 1, an electronic device 99 includes an electrical connector assembly 100 and a main body 200. The electrical connector assembly 100 includes a socket 10 and a plug 20. The socket 10 is mounted in the main body 200. In this embodiment, the electronic device 99 is, but is not limited to, a notebook computer, and the electrical connector assembly 100 is, but is not limited to, a power-supply electrical connector assembly.

Figure 2:
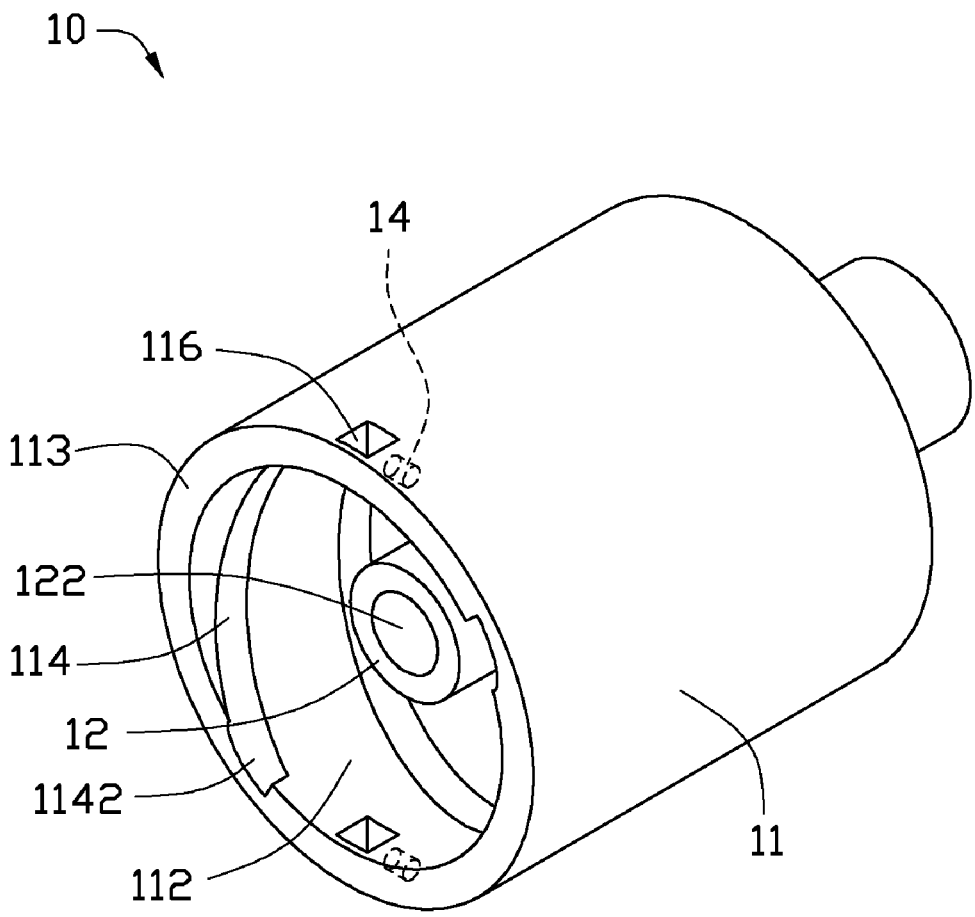
FIG. 2 is an isometric view of a socket of the electrical connector assembly of FIG. 1.

Referring to FIG. 2, the socket 10 includes a main body 11. The main body 11 defines a longitudinal receiving space 112 including an opening (not labeled) formed on an end 113 of the main body 11. In this embodiment, the main body 11 and the receiving space 112 are substantially cylindrical. A helical slot 114 is formed in the sidewall of the receiving space 112. The helical slot 114 includes at least one entrance 1142 formed on the end 113. In this embodiment, the helical slot 114 includes two entrances 1142 symmetrically relative to the axis of the receiving space 112. The socket 10 further includes a shaft 12. One end of the shaft 12 is secured in the main body 200, and an opposite end is received in the receiving space 112. The main body 11 is rotatably fixed in place on the shaft 12. The shaft 12 defines a longitudinal shaft hole 122. The receiving space 112, the shaft 12, and the shaft hole 122 are coaxial to each other. The sidewall of the main body 11 further defines at least one through hole 116 communicating with the receiving space 112 and adjacent to the end 113. The socket 10 further includes at least one magnetic member 14, each mounted in the sidewall of the main body 11 and adjacent to one through hole 116. In this embodiment, two through holes 116 and two magnetic members 14 are symmetrically deployed relative to the axis of the receiving space 112.

Figure 3:
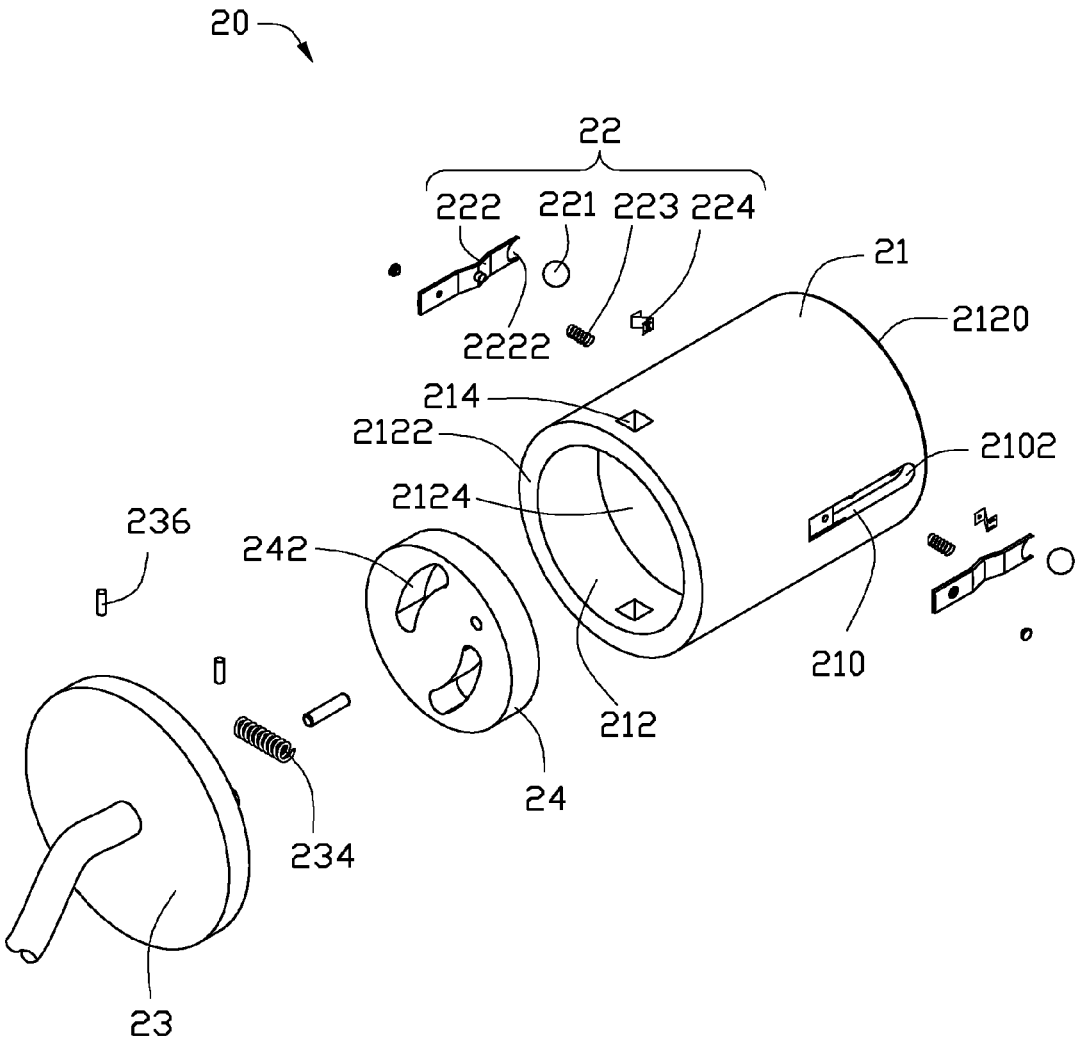
FIG. 3 is an exploded, perspective view of a plug of the electrical connector assembly of FIG. 1.
Figure 4:
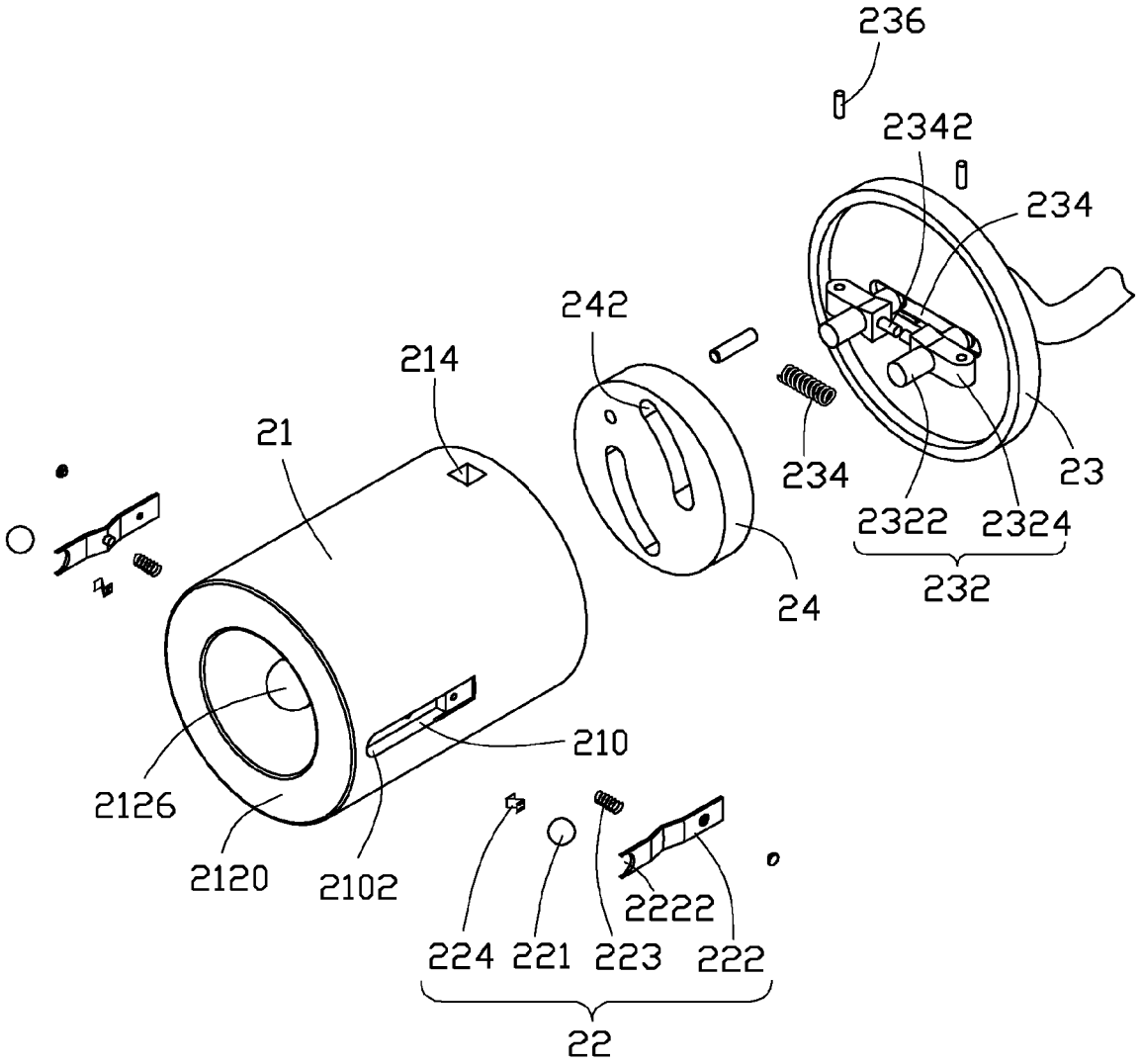
FIG. 4 is another exploded, perspective view of a plug of the electrical connector assembly of FIG. 1, viewed from another viewpoint.

Referring to FIGS. 3-4, the plug 20 includes a main body 21 and at least one fixing assembly 22 mounted in the main body 21. In this embodiment, the main body 21 is substantially cylindrical, and the diameter of the main body 21 is substantially equal to that of the receiving space 112. The peripheral sidewall of the main body 21 defines at least one longitudinal limiting slot 210 to receive the at least one fixing assembly 22. Each limiting slot 210 includes a semicircular distal end 2102 adjacent to an end 2120 of the main body 21. In this embodiment, two fixing assemblies 22 and two limiting slots 210 are symmetrically deployed relative to the axis of the main body 21.

Each fixing assembly 22 includes a ball 221, a latching member 222, and elastic members 223, 224. The shape of the latching member 222 is adapted to the limiting slot 210, so the latching member 222 can be fixed within the limiting slot 210. The latching member 222 includes a semicircular distal end 2222 diameter of which equals that of the distal end 2102. The latching member 222 is fixed within the limiting slot 210, and the distal ends 2222, 2102 cooperatively form a circular. The diameter of the ball 221 is greater than that of the circle. The ball 221 is rotatably received in the limiting slot 210 and extends partially out of the limiting slot 210 through the circle. It should be noted that there are other ways to cause the ball 221 to be rotatably connected to the main body 21 and extend partially out of the main body 21. The extending part of the ball 221 can slide into the helical slot 114 through the entrance 1142. One end of the elastic member 223 is secured in the limiting slot 210, and an opposite end is secured to the latching member 222, so the elastic member 223 can provide spring force to prevent the latching member 222 from being deformed when an external force is exerted on the latching member 222. One end of the elastic member 224 is secured in the limiting slot 210, and an opposite end is secured to the ball 221 to cause the ball 221 to extend partially out of the limiting slot 210.

The main body 21 defines a longitudinal receiving space 212 and at least one through hole 214 adjacent to an opposite end 2122 of the main body 21. In this embodiment, two through holes 214 are symmetrically disposed relative to the axis of the main body 21. When the plug 20 is inserted into the socket 10 and approaches a position electrically connecting thereto, each through hole 214 aligns with one through hole 116. A stopper plate 2124 is fixed within the receiving space 212, and a rod 2126 protrudes from the stopper plate 2124 and extends toward the end 2120. The rod 2126 and the main body 21 are coaxial to each other. The diameter of the rod 2126 is substantially equal to that of the shaft hole 122.

The plug 20 further includes a knob 23 and a fixing plate 24 secured to the stopper plate 2124. The fixing plate 24 defines two guide slots 242 extending through the fixing plate 24 and symmetrically relative to the axis of the fixing plate 24. Each guide slot 242 extends around and gradually departs from the axis of the fixing plate 24.

The knob 23 defines a sliding slot 234 facing the fixing plate 24. In this embodiment, the sliding slot 234 is symmetrical relative to the axis of the knob 23. The knob 23 includes two connecting members 232 slideably received in the sliding slot 234. Each connecting member 232 includes a connecting rod 2322 and a supporting element 2324 secured to the connecting rod 2324. Two opposite ends of one of the connecting rods 2322 are respectively slideably received in the sliding slot 234 and one of the guide slots 242, and two opposite ends of the other connecting rod 2322 are respectively slideably received in the sliding slot 234 and the other guide slot 242. The knob 23 further includes two magnetic members 236 and an elastic member 234. The magnetic members 236 are respectively mounted in the two supporting elements 2324 and away from the axis of the knob 23. The supporting elements 2324 respectively include protrusions 2342 facing each other. The elastic member 234 is arranged over the protrusions 2342 and resists the supporting elements 2324 to cause the connecting members 232 to stay in a predetermined position. In this embodiment, the elastic member 234 is a coil spring.

Figure 5:
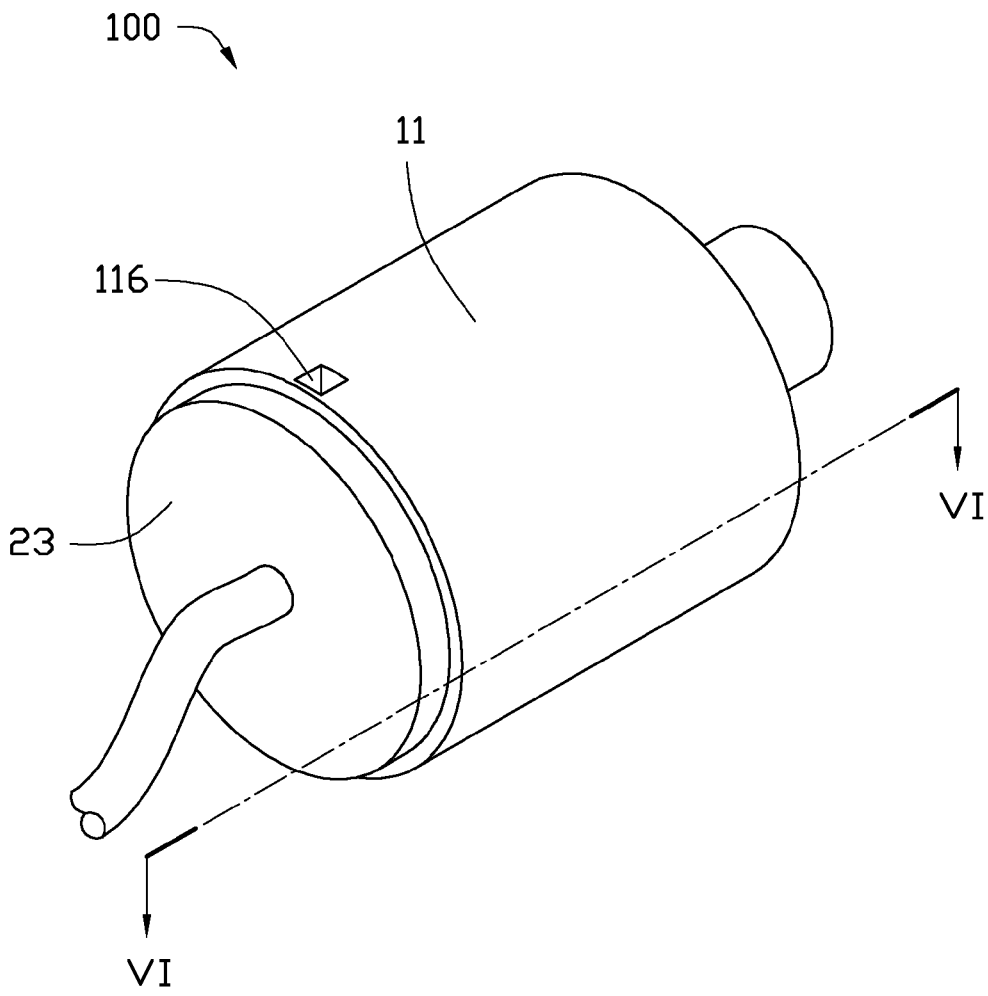
FIG. 5 is an isometric view of the electrical connector assembly of FIG. 1.
Figure 6:
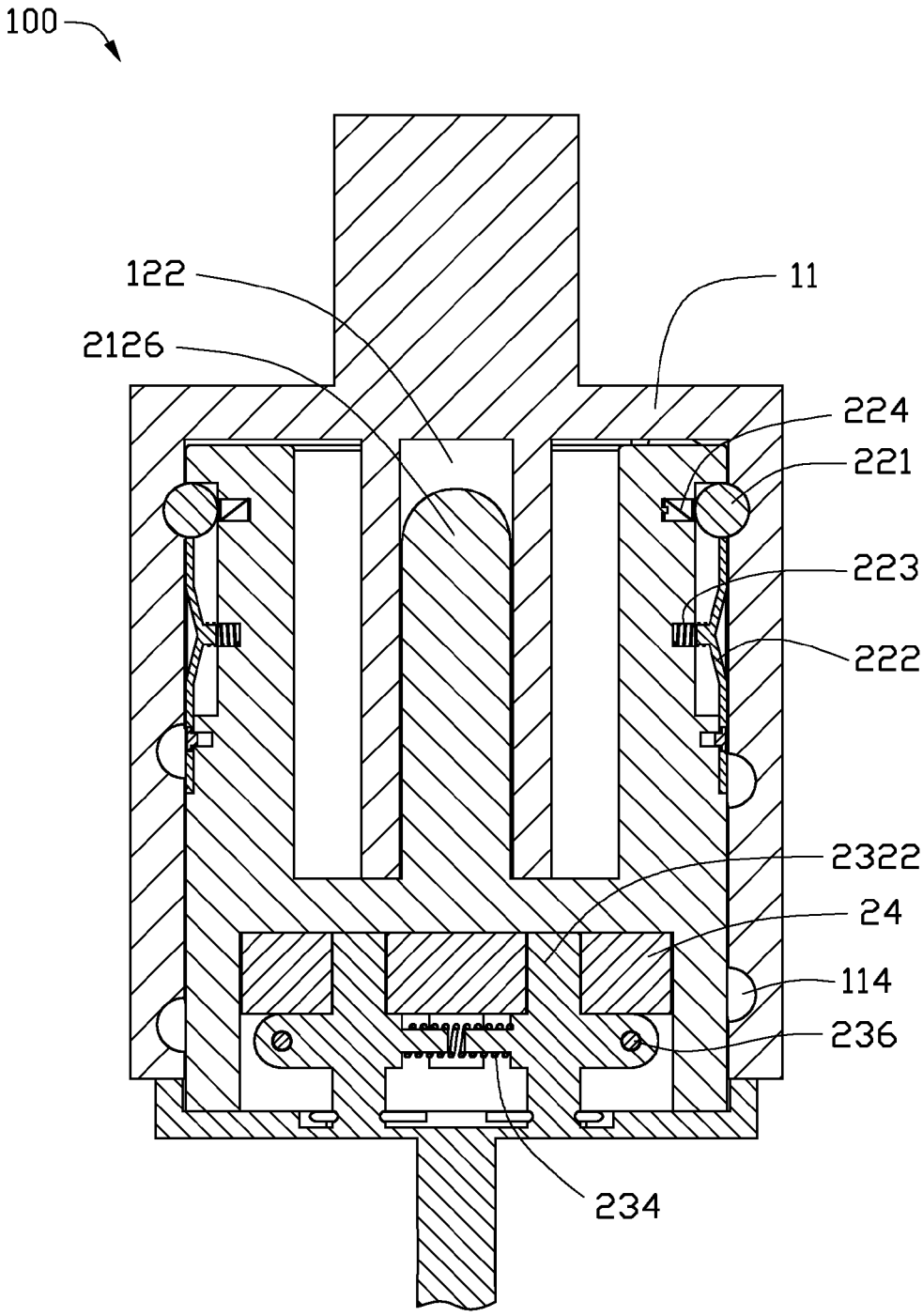
FIG. 6 is a cross-section of the electrical connector assembly of FIG. 5, taken along line VI-VI.

Referring also to FIGS. 5-6, to connect the plug 20 to the socket 10, the balls 221 are respectively placed in the entrances 1142, and the rod 2126 is placed in the shaft hole 122. The plug 20 is then pushed into the socket 10 along the axis of the socket 10. With force on the plug 20, the main body 11 rotates about the shaft 12 in a direction to slide the balls 221 to into the helical slot 114. When the balls 221 stop sliding in the helical slot 114, the plug 20 may not be pushed into the socket 10 any more. At this point, the plug 20 is electrically connected to the socket 10, and each through hole 214 aligns with one through hole 116. To further secure the plug 20, the knob 23 is rotated in a direction to slide the connecting rods 2322 to in the guide slots 242. During rotation of the knob 23 the distance between the two connecting members 232 gradually increases and the magnetic members 236 gradually approaches the sidewall of the receiving space 112. As the knob 23 is rotated to a position where the supporting elements 2324 respectively align with the through holes 214, the magnetic members 14 attract the magnetic members 236, further securing the plug 20 in the socket 10.

For withdrawal of the plug 20, the knob 23 is rotated in an opposite direction to retract the magnetic members 236 from the magnetic members 14 and the plug 20 is pulled along the axis of the main body 11. Commensurately, the main body 11 rotates about the shaft 12 in an opposite direction, retracting the balls 221 out of the helical slot 114. In this embodiment, with such configuration, the plug 20 cannot be easily pulled out of the socket 10, thus preventing the electronic device 99 from accidental power down.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. An electrical connector assembly comprising:

a socket comprising a first main body, the first main body defining a first longitudinal receiving space, a sidewall of the first longitudinal receiving space defining a helical slot, the helical slot comprising at least one entrance formed on an end of the first longitudinal receiving space; and a plug comprising a second main body and at least one fixing assembly mounted in a peripheral sidewall of the second main body, each of the at least one fixing assembly comprising a ball rotatably connected to and extending partially out of the peripheral sidewall of the second main body, the extending part of the at least one ball being able to slide into the helical slot through the at least one entrance.

2. The electrical connector assembly as described in claim 1, wherein the diameter of the second main body is equal to that of the first longitudinal receiving space.

3. The electrical connector assembly as described in claim 1, wherein the socket further comprises a shaft, the main body is rotatably fixed in place on the shaft.

4. The electrical connector assembly as described in claim 3, wherein the shaft defines a longitudinal shaft hole, the second main body defines a second longitudinal receiving space, the socket further comprises a stopper plate secured within the second longitudinal receiving space and a rod protruding from the stopper plate and extending along an axis of the second longitudinal receiving space, the diameter of the rod is equal to or slightly less than that of the shaft hole.

5. The electrical connector assembly as described in claim 1, wherein the peripheral sidewall of the second main body defines at least one longitudinal limiting slot, each of the at least one longitudinal limiting slot comprises a first semicircular end adjacent to an end of the second main body, each of the at least one fixing assembly further comprises a latching member, each of the at least one latching member comprises a second semicircular end, each of the at least one first semicircular end and one of the at least one second semicircular end cooperatively form a circle which diameter is less than that of each of the at least one ball, the at least one ball extends partially out of the at least one longitudinal limiting slot through the at least one circle.

6. The electrical connector assembly as described in claim 5, wherein each of the at least one fixing assembly further comprises a first elastic member, one end of each of the at least one first elastic member is secured to a sidewall of one of the at least one longitudinal limiting slot, and an opposite end of each of the at least one first elastic member is secured to one of the at least one latching member.

7. The electrical connector assembly as described in claim 5, wherein each of the at least one fixing assembly further comprises a second elastic member, one end of each of the at least one second elastic member is secured to a sidewall of one of the at least one longitudinal limiting slot, and an opposite end of each of the at least one second elastic member is secured to one of the at least one ball.

8. The electrical connector assembly as described in claim 1, wherein the helical slot comprises two entrances symmetrically relative to an axis of the first longitudinal receiving space, and the socket comprises two fixing assemblies symmetrically relative to an axis of the second main body.

9. The electrical connector assembly as described in claim 1, wherein the plug further comprises a knob and a fixing plate secured within the second main body, the fixing plate defines two guide slots symmetrically relative to an axis of the fixing plate, each of the guide slots extends around and gradually departs from an axis of the fixing plate, the knob defines a sliding slot facing the fixing plate, the knob further comprises two connecting members and an elastic element, opposite ends of one of the connecting members are respectively slideably received in one of the guide slots and the sliding slot, and opposite ends of the other one of the connecting members are respectively slideably received in the other one of the guide slots and the sliding slot, opposite ends of the elastic element respectively resist the connecting members.

10. The electrical connector assembly as described in claim 9, wherein the socket further comprises at least one first magnetic member, a peripheral sidewall of the first main body defines at least one first through hole adjacent to the at least one entrance, the at least one first magnetic member is mounted in the sidewall of the first main body and each of the at least one first magnetic member is adjacent to one of the at least one through hole, the plug further comprises at least one second magnetic member mounted in the connecting members and away from an axis of the knob, the peripheral sidewall of the second main body defines at least one second through hole away from the at least one ball, when the plug is electrically connected to the socket, each of the at least one second through hole aligns with one of the at least one first through hole, when the knob is rotated to cause each of the at least one second magnetic member aligns with one of the at least one second through hole, the at least one first magnetic member attracts the at least one second magnetic member.

* * * * *